US006478089B2

(12) United States Patent
Alves et al.

(10) Patent No.: US 6,478,089 B2
(45) Date of Patent: Nov. 12, 2002

(54) AUTOMATIC CHEMICAL STICK LOADER FOR WELLS AND METHOD OF LOADING

(76) Inventors: Lee Alves, 1421 W. Alabama, Hobbs, NM (US) 88242; Kennith Shade, 615 N. 1st St., Carlsbad, NM (US) 88220

( * ) Notice: Subject to any disclaimer, the term of this patent is extended or adjusted under 35 U.S.C. 154(b) by 43 days.

(21) Appl. No.: 09/810,165

(22) Filed: Mar. 19, 2001

(65) Prior Publication Data

US 2002/0129941 A1 Sep. 19, 2002

(51) Int. Cl.[7] ..... E21B 37/06
(52) U.S. Cl. ..... 166/310; 166/53; 166/75.15
(58) Field of Search ..... 166/75.15, 75.11, 166/310, 311, 309, 70, 53, 324, 92.1, 332.8, 86.3; 137/268

(56) References Cited

U.S. PATENT DOCUMENTS

| | | | |
|---|---|---|---|
| 3,403,729 A | 10/1968 | Hickey | |
| 4,785,880 A | 11/1988 | Ashton | |
| 4,929,138 A | 5/1990 | Breuning | |
| 5,188,178 A | 2/1993 | Noyes | |
| 5,813,455 A | 9/1998 | Pratt et al. | |
| 6,039,122 A | 3/2000 | Gonzalez | |
| 6,044,905 A | 4/2000 | Harrison, III | |
| 6,056,058 A | 5/2000 | Gonzalez | |
| 6,269,875 B1 * | 8/2001 | Harrison et al. | 166/53 |

FOREIGN PATENT DOCUMENTS

| | | |
|---|---|---|
| DE | 3528743 A1 | 5/1990 |
| SU | 1738597 A1 | 6/1992 |

* cited by examiner

*Primary Examiner*—David Bagnell
*Assistant Examiner*—Shane Bomar
(74) *Attorney, Agent, or Firm*—Richard C. Litman

(57) ABSTRACT

An automatic chemical stick loader apparatus for gas wells, including a storage and dispensing cabinet at ground level, for sequentially feeding sticks therefrom, a launch tube for sequentially receiving sticks and elevating them to the top of a well head, and a stick loader atop the well for receiving a stick from the launch tube, dropping the stick into a chamber, pressure isolating the chamber and pressure equalizing it with well pressure, and dropping the stick into the well. The apparatus is controlled by an electronic controller which may be solar powered. The apparatus is operated by well gas, the pressure thereof being regulated down to 20 psi or so.

16 Claims, 11 Drawing Sheets

AUTOMATIC CHEMICAL STICK LOADER FOR WELLS AND METHOD OF LOADING

BACKGROUND OF THE INVENTION

1. Field of the Invention

The present invention relates generally to wells, particularly gas well stick loaders and, more specifically, to a ground-level filled, automatic chemical stick loader for a gas well.

2. Description of the Related Art

The related art of interest describes various loaders, but none discloses the present invention. Soap sticks are inserted into gas and oil wells to emulsify and remove excess water from the well. Other chemical sticks are inserted periodically to clean built-up paraffin deposits from the well wall. Still other chemical sticks (e.g., lubricants, corrosion inhibitors) are employed in other circumstances to keep the well clean and thus productive.

Several devices have been proposed for automating the process of inserting sticks into a well. However, a common problem is that most automated devices do not permit safe loading of chemical sticks into the device at ground level. There is a need for an efficient portable automatic loader of soap sticks for gas wells from ground level. The related art will be discussed in the order of perceived relevance to the present invention.

U.S. Pat. No. 6,044,905, issued on Apr. 4, 2000 to William G. Harrison III, describes a rotary carousel-type chemical stick storage and delivery system comprising a cylindrical storage container on top of a delivery tube, means for aligning the chemical stick with the bore hole, and synchronized valve means for allowing the stick to enter the bore without releasing the pressure of the bore. The chemical stick storage and delivery system is distinguishable for its rotary magazine attached directly overhead to an oil or gas well. It can be dangerous to refill the device with sticks, not only because of the elevated loading height (16 feet or more, reached only with a ladder), but also because equalized gas from the well is in the device and when opened, presents a distinct and dangerous, potentially explosive condition.

U.S. Pat. No. 6,056,058, issued on May 2, 2000, and U.S. Pat. No. 6,039,122, issued on Mar. 21, 2000, to Leonel Gonzalez describe methods and apparatus for automatically launching chemical sticks into oil and gas wells by feeding from an overhead carousel stick feeder magazine. The apparatus is distinguishable for its overhead attachment and feeding from a carousel magazine and, again, the need to refill from a height which is dangerous to the loader, to say nothing of accumulated equalized pressure gas in the carousel from the well.

U.S. Pat. No. 3,403,729, issued on Oct. 1, 1968 to Charles J. Hickey, describes an apparatus for controlled ejectment of rubber or nylon balls into wells for hydraulic fracturing. The apparatus is operated manually by rotating a carousel container having vertically stacked balls to feed a ball directly to the well by a horizontal attachment (expeller-counter assembly) having a plunger actuated by a reciprocatory shaft and handle. The apparatus is distinguishable for its direct and permanent attachment structure, and manual actuator system.

U.S. Pat. No. 5,813,455, issued on Sep. 29, 1998 to Gary V. Pratt et al., describes a tubular soap stick receptacle attached vertically to a well bore. An upper storage section storing sticks end-to-end supplies the lower receiving section. The sticks are dispensed on a timing sequence or when a predetermined well condition is reached. The apparatus is distinguishable for its requirement of elevated loading, as seen in FIG. 5 of this patent, gas equalization throughout the entire interior of the apparatus to dispense a stick, and the need for relatively elevated gas pressure within the well to operate the dispensing system. Gas then vented from this device is excessively wasteful and dangerous.

U.S. Pat. No. 4,785,880, issued on Nov. 22, 1988 to Robert Ashton, describes a carousel type soap stick dispenser attached vertically to the well bore. A double acting cylinder and piston sequentially operate a plurality of valves associated with the well. The handles of each valve have a spring steel tine secured thereto which engages the piston shaft to actuate each valve. The apparatus is distinguishable for its permanent vertical attachment structure requiring valve operation.

U.S. Pat. No. 5,188,178, issued on Feb. 23, 1993 to Jonathan C. Noyes, describes a carousel magazine attached vertically to a well for feeding soap sticks directly into the well. A solar powered battery and pressure sensing means dispense the soap sticks. The apparatus is distinguishable for its direct vertical attachment to a wellhead.

U.S. Pat. No. 4,929,138, issued on May 29, 1990 to Kurt Breuning, and German Patent Application No. 35 28 743 A1, published on May 29, 1987, describe a machine apparatus for feeding rodlike workpieces to a machine tool. An inclined magazine feeds two octagonal geared rotatable guide elements having alternating holding and guiding recesses in a housing. The apparatus is distinguishable for its geared mechanism.

Soviet Union Patent Application No. 1738597 A1, published on Jun. 7, 1992, describes an apparatus for aligning tapered roller bearing races employing a revolving drum with windows containing spring loaded conical catches in an auxiliary drum, in which the catches engage the conical bores of the race components ascending a vertical elevator from a hopper. The apparatus is distinguishable for its drum structure.

None of the above inventions and patents, taken either singularly or in combination, is seen to describe the instant invention as claimed. Thus, an automatic chemical stick loader for gas wells solving the aforementioned problems is desired.

SUMMARY OF THE INVENTION

The automatic chemical stick loader for gas wells is a three part system made up of a programmable electronic (computer) controller for operation of the loader apparatus, a weather-proof cabinet for storage of a quantity of chemical sticks, an upwardly-pivotable launch tube that receives a single stick from the storage cabinet and then pivots upwardly over the well head with the stick sliding down the tube to a dispensing position over the well head, and a catch and release assembly to load a stick into the well. Parts are operable from pressures as low as 20 psi or so, and the stick storage cabinet can be filled with sticks from ground level, thus providing a significant safety feature in that an operator no longer has to climb up a ladder to load a magazine-type loader, for example, a dangerous procedure at best. The launch tube is curved to minimize frictional contact with the stick as it slides down the tube, and to permit location of the stick storage cabinet close by its well head. Parts are uncomplicated and require no external power or energy source to operate; preferably, the electronic controller is solar powered.

Accordingly, it is a principal object of the invention to provide an automatic, linear stick feeder apparatus for gas wells.

It is another object of the invention to provide an automatic stick feeder apparatus for a gas well operable entirely from well pressures, which may be as low as 20 psi or so.

It is a further object of the invention to provide an automatic soap stick feeder apparatus having an automatic controllable feeding mechanism in an easily accessed housing (from ground level) containing a rack of sticks, with a loader and pivoting launch tube to raise a stick and position it over the well head.

Still another object of the invention is to provide an automatic stick feeder with a weather-proof storage cabinet apparatus comprising a stick housing on adjustable-height legs.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

As explained above, the essential parts of the invention include a programmable electronic (computer) controller 100, wired to a microswitch and gas valve assembly for operating a gas cylinder and piston on a storage cabinet for initial dispensing of chemical sticks, and the other gas cylinder and piston for lifting the launch tube, a weather-proof stick storage and dispensing cabinet 200 for a quantity of chemical sticks, and a launch tube and stick loader assembly 300 for transporting a stick from the cabinet 200 to above the well head and loading the same through a gas pressure lock assembly and into the well.

The programmable electronic (computer) controller 100, which may be solar powered, as at 114, operates to allow chemical sticks C within the cabinet 200 to be dispensed to a launch tube 302 at an appropriate time as determined from the controller 100. The parameters of time, weather conditions, well conditions, etc. can be factors employed in determining when it is time to load a particular stick into the well. The details of controller are not the primary concern with the present invention.

Figure 1:
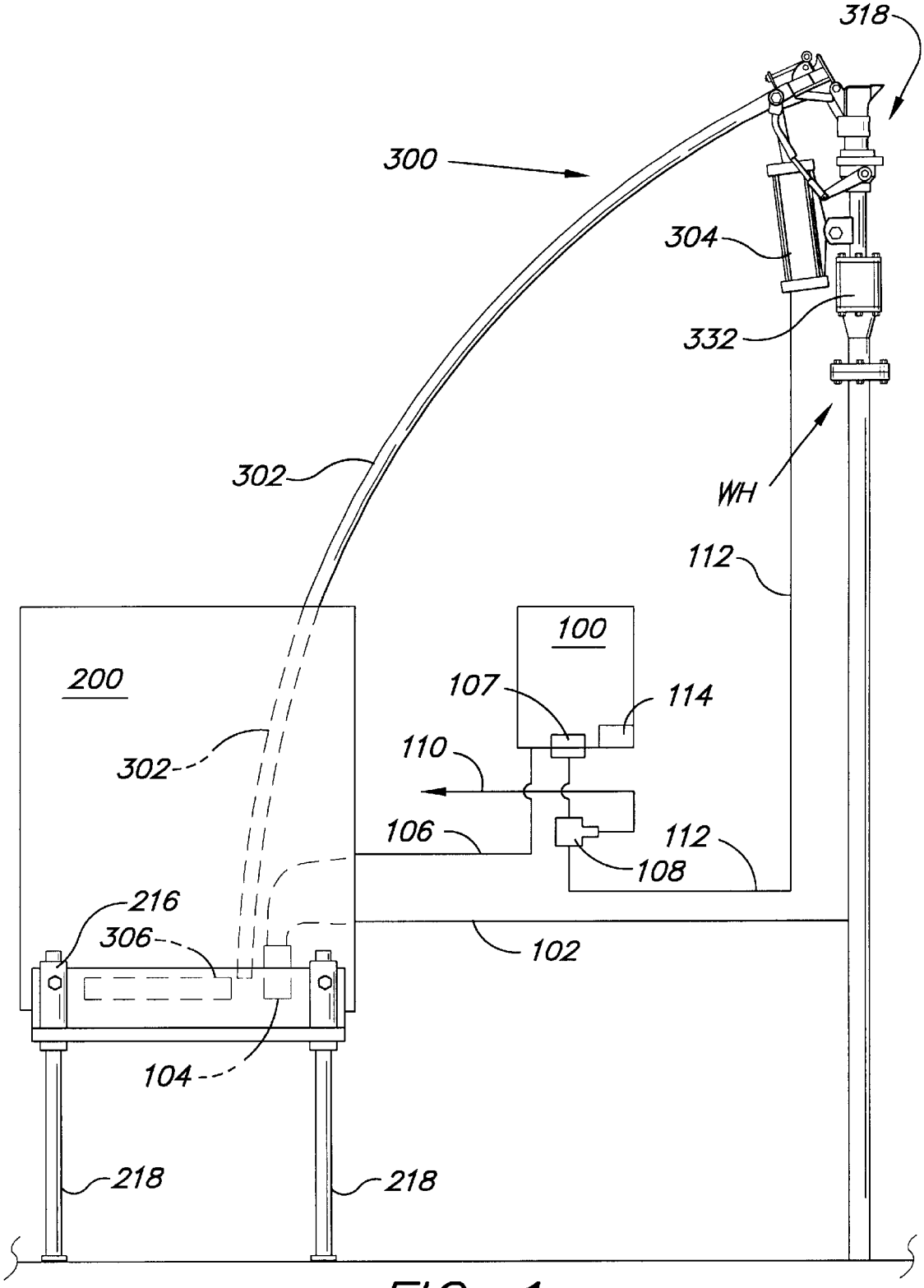
FIG. 1 is a diagrammatic view showing the essential parts of the overall invention.
Figure 11:
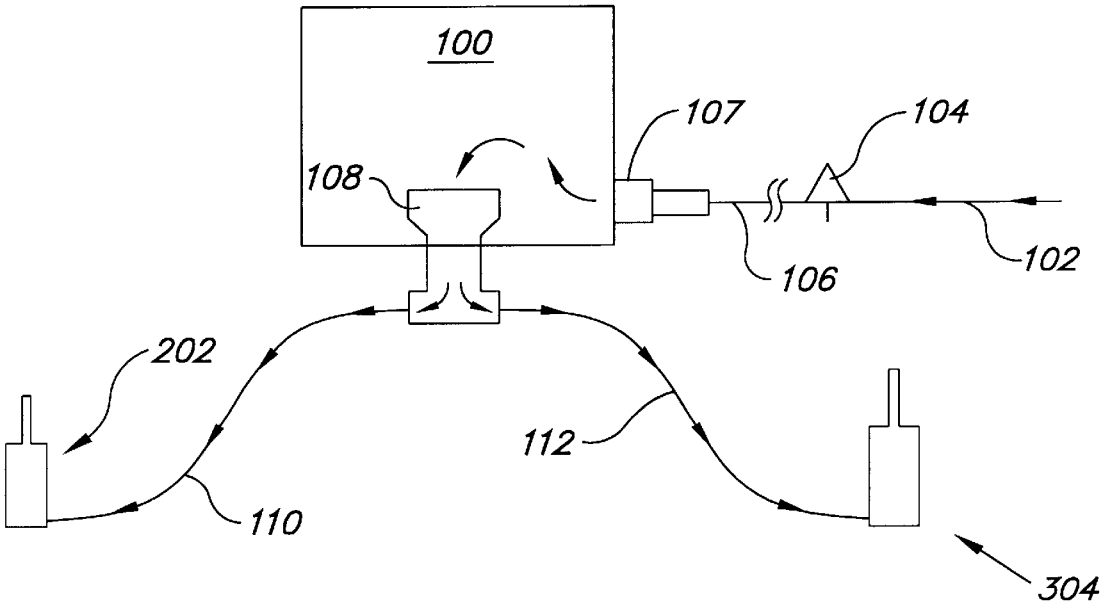
FIG. 11 is a schematic diagram of the controller system of the invention, including a programmable electronic controller.

In any event, a first gas line 102 under well pressure (which may range up to 2000 psi or more) is connected to a gas regulator 104 for reducing pressure to a working pressure of about 20 psi. From there, regulated gas travels through line 106 to a microswitch 107. With further reference to FIG. 1 and also the schematic diagram of FIG. 11, the microswitch 107 operable from the controller 100 allows controlled-pressure gas to flow to a T 108, and then through a first line 110 to an air (gas) cylinder 202 (see FIG. 3) which pushes individual sticks C onto the launch tube 302, and second at 112 to launch tube lift cylinder 304 (see FIG. 5). Controlled-pressure gas is thus fed simultaneously to both cylinders 202 and 304.

However, it is to be noted here that the internal piston diameters of the respective cylinders 202 and 304 are sized such that gas pressure operates chemical stick dispensing cylinder 202 first and then operates launch tube lift cylinder 304 second. The diameter of cylinder 202 can be about one inch or so while the diameter of cylinder 304 could be four inches or more. Of course, these are exemplary dimensions only. This assures that a chemical stick C is in the launch tube before it is raised to load the stick C into the well.

Figure 2:
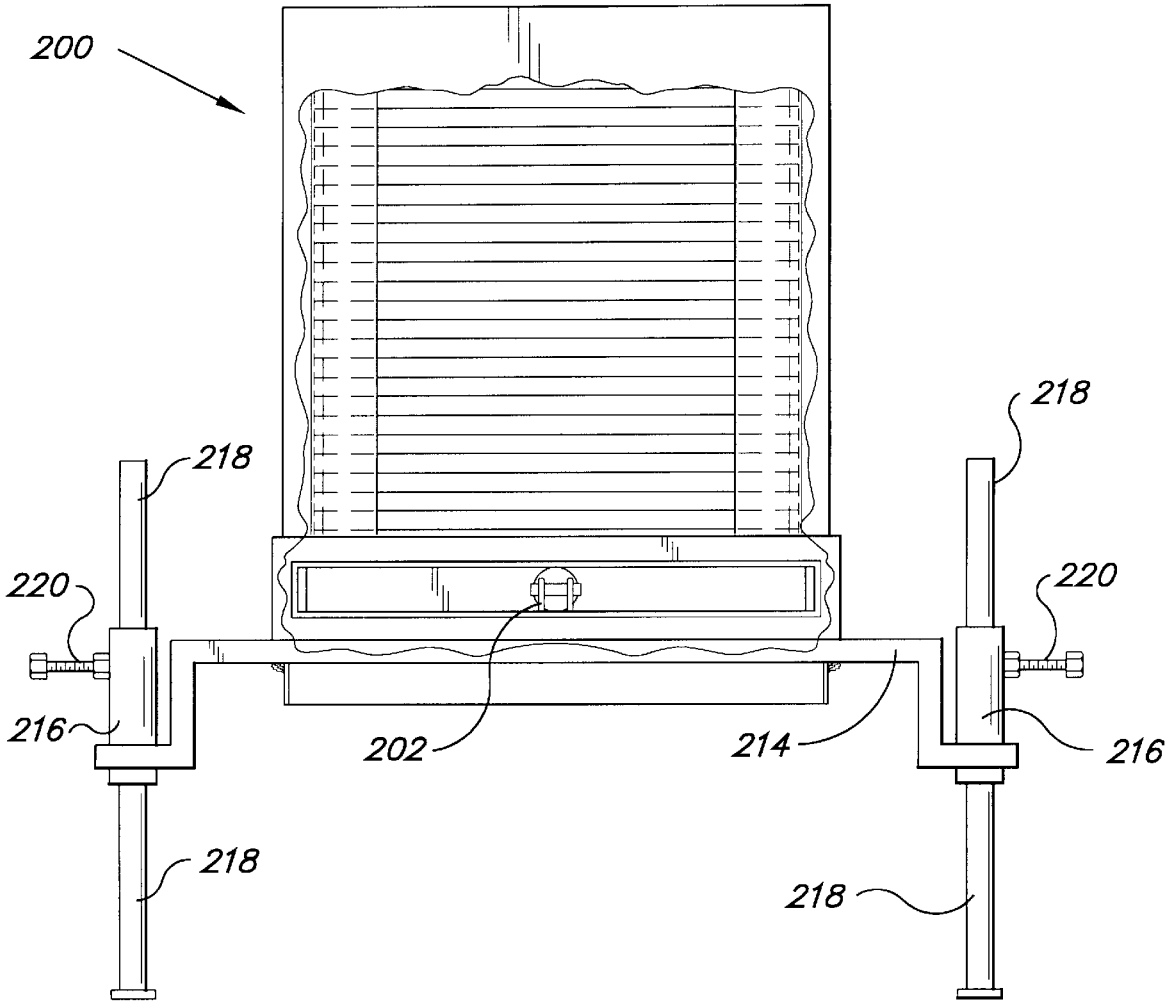
FIG. 2 is a front elevational view of a stick-containing cabinet, with parts broken away to reveal interior details.
Figure 3:
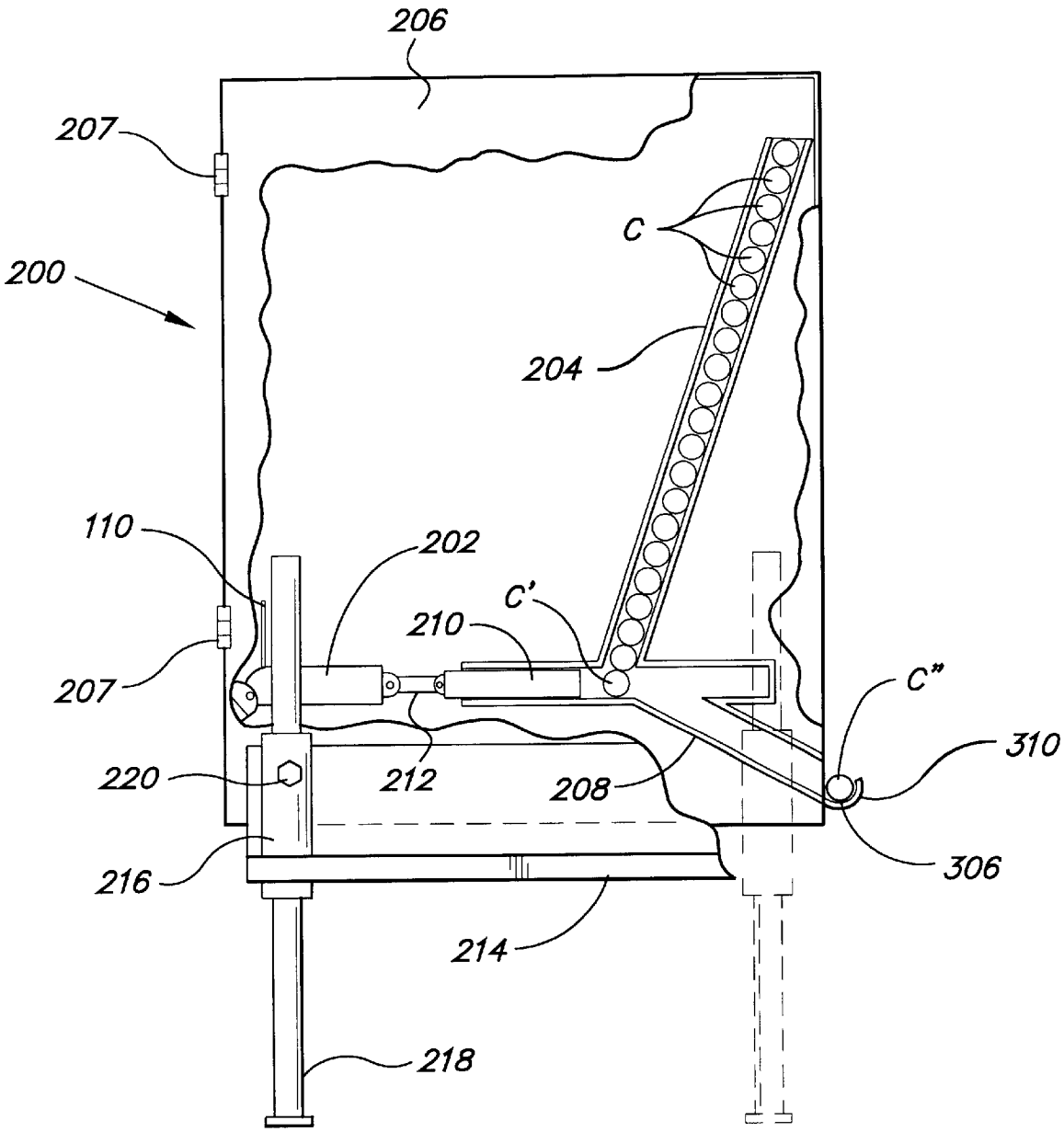
FIG. 3 is a side elevational view of the stick cabinet shown in FIG. 2, with parts broken away to reveal interior details.

Details of the construction and operation of the height-adjustable, storage and dispensing cabinet 200 will now be discussed. With particular reference to FIGS. 2 and 3, the cabinet is essentially a box-shaped enclosure, on all sides, and thus provides a weather-proof environment for a supply of chemical sticks C. An inclined storage bin 204 retains a supply of sticks C. Sticks C are loaded into the bin 204, which is accessed through a door 206, hinged at 207 as seen in FIG. 3. As seen in FIG. 3, a stick C' ready for loading is advanced horizontally to the right in the sense of the figure to an inclined ramp 208, where under the force of gravity, a stick C" rolls onto the open cradle end 306 of launch tube 302, under influence of ram 210 driven from the piston of cylinder 202 via a suitable linkage 212. Return springs (not shown) , which may be tension or compression springs, return the ram 210 and the piston of cylinder 202 to their initial positions as seen in FIG. 3 after a stick C" is loaded onto cradle 306.

The cabinet 200 is supported on a platform 214 provided with four sleeves 216 at the four corners of the cabinet. Height adjustable, footed legs 218 are secured in place each in its respective sleeve 216 by set screws 220. It is to be appreciated that the ground terrain adjacent a gas well is often quite irregular and hilly, and thus the adjustable legs as just described allow the cabinet 200 to be set upright and level at any selected location.

Again with reference to FIG. 1, it is important to note here that the cabinet is positioned relatively close to the ground. The overall cabinet height is about 6 feet, ground to the cabinet top. This permits loading of sticks C into bin 204 through slot 206 without need of a ladder; obviously, the height of the slot 206 will be somewhat less than 6 feet. In any typical gas field, the height of the well head WH is about 8 feet above ground level. The major deficiency with prior art loaders, especially the carousel-type loaders, is that they have to be refilled from the top, at ten or twelve feet above the ground. The person reloading the loader has to climb a ladder to accomplish the task. This is inherently dangerous, given the typical rough terrain of a gas field, and slows the process as sticks have to be carried up the ladder and loaded into the loader.

Figure 4:
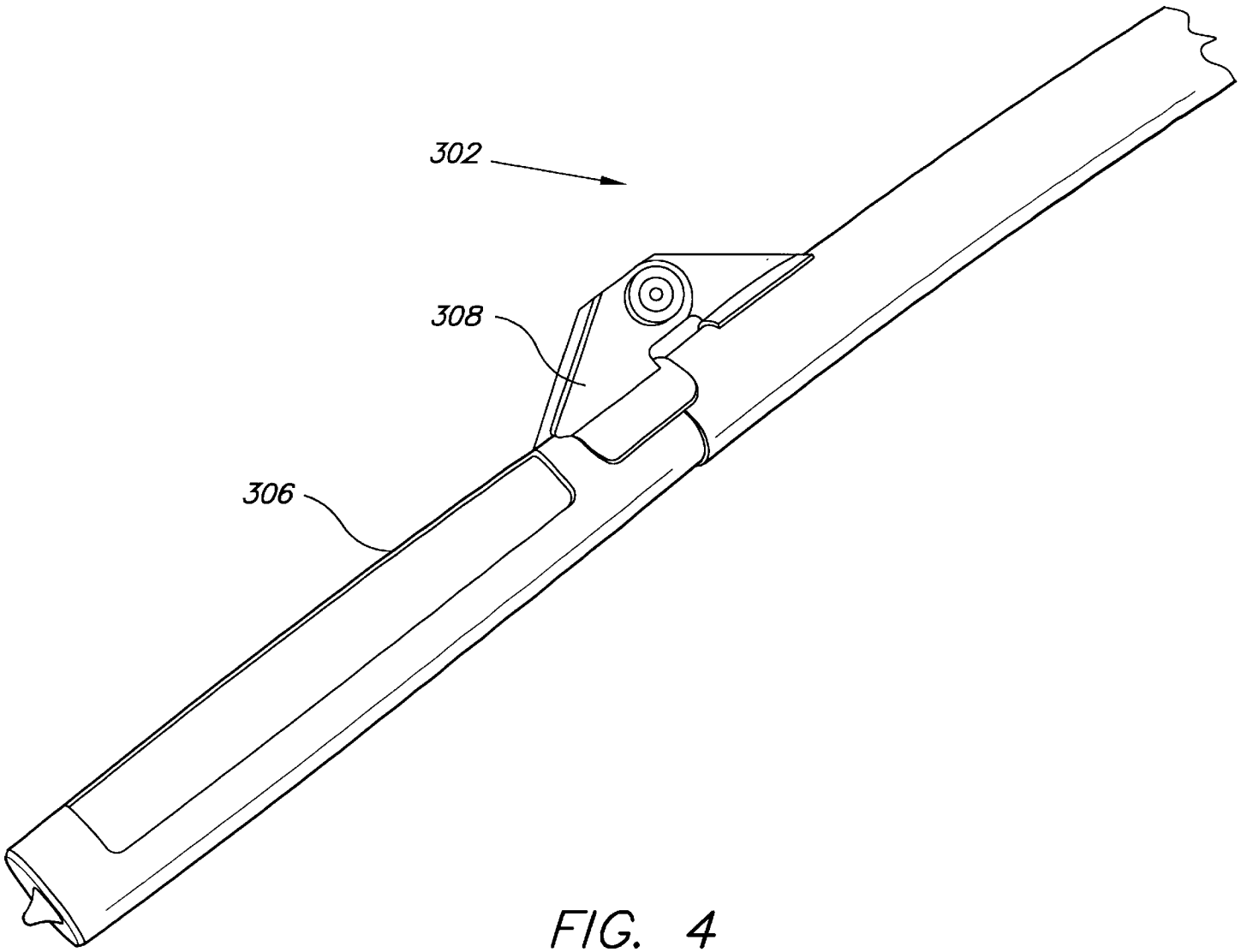
FIG. 4 is a perspective view of the stick-receiving end of the launch tube.

Referring now to FIGS. 1, 3 and 4, the construction and peration of launch tube 302 will be explained. As seen in FIG. 4, cradle end 306 is connected to the main body of launch tube 302 by a hinge 308. When tube 302 is in a lowered position to receive a stick, the cradle end is supported by a pair of arms 310 adjacent the open of ramp 208, and the hinge 310 allows the cradle end 306 to pivot upwardly to a level disposition, as seen in FIG. 1. As gas cylinder 304 is operated to lift the launch tube 302 with a stick, the cradle end straightens out and pivots to the position indicated in FIG. 4, aligned with the main body of launch tube 302.

Figure 6:
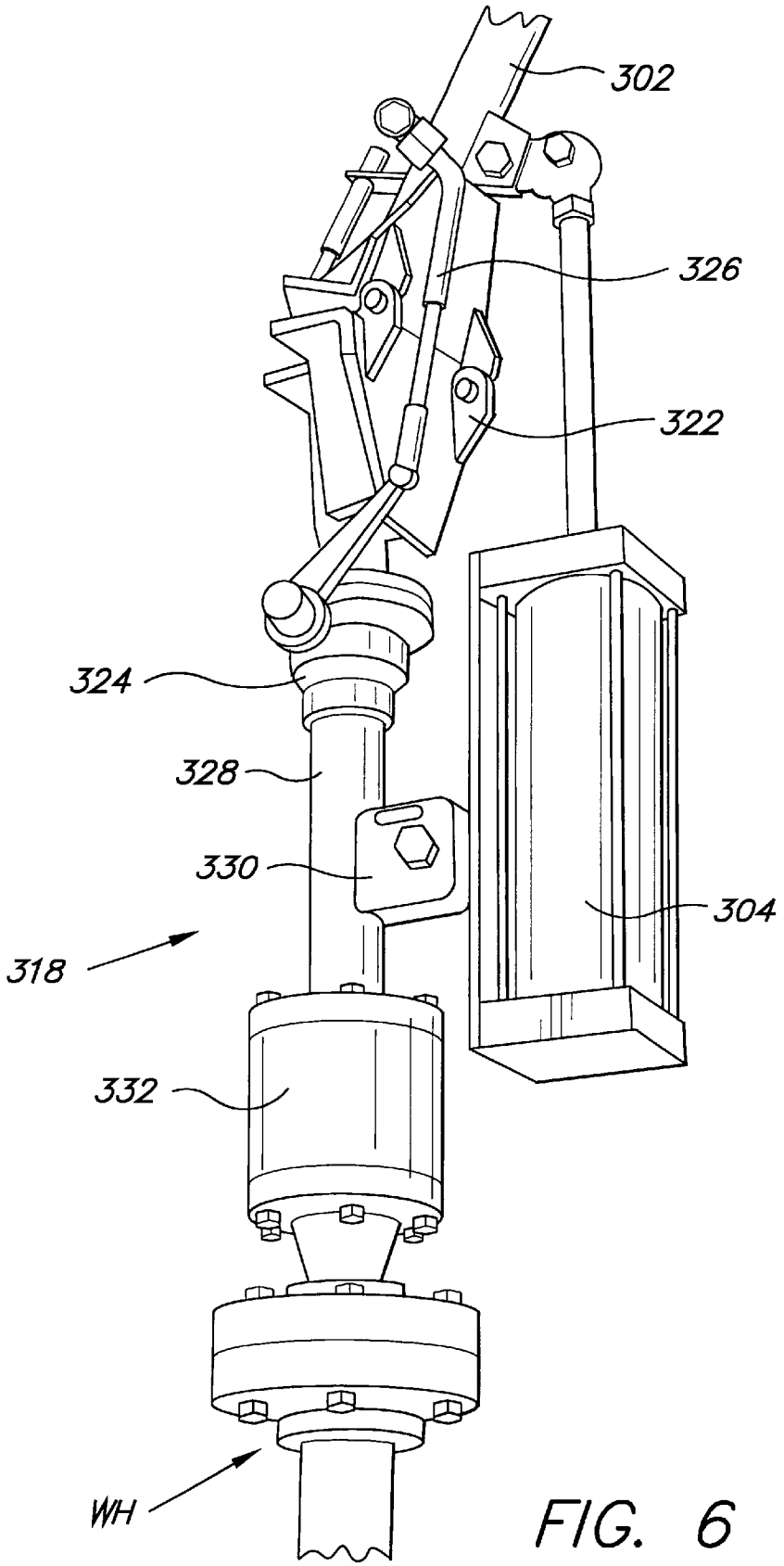
FIG. 6 is a perspective view of the mechanism shown in FIG. 5 with the launch tube raised.
Figure 9:
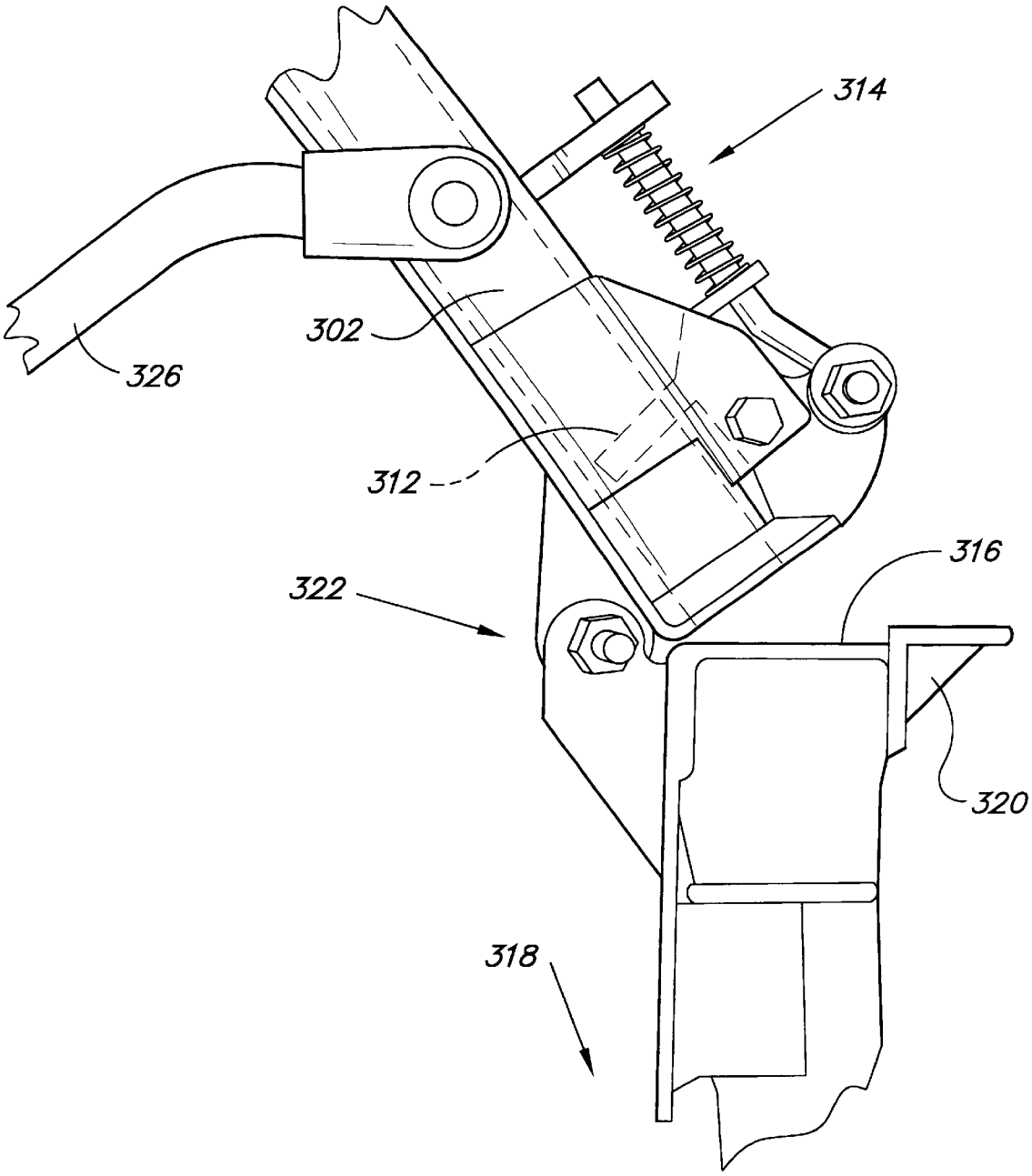
FIG. 9 is an elevational view of the stick catch device at the top of the stick loader mechanism atop the well head.

As the tube 302 reaches its uppermost position as seen in FIG.6, the stick will slide from the cradle 306, down and inwardly of the tube 302, to abut against the internal catch 312 of a latch 314, as best seen in FIG. 9. Of course, the catch 312 simply retains the stick in the tube 302 until it is fully elevated and aligned with entrance throat 316 of the stick loader 318 mounted on well head WH. At that point, a foot 320 engages the latch 314, releasing the catch 312 from the stick and allowing it to enter into the stick loader 318.

In most cases, the major length of the launch tube 302 is curved or bowed (FIG. 1) for two reasons. First, the bowed configuration permits the cabinet 200 to be positioned very close to the well with which it is used. Second, the curved configuration permits a stick to slide down the tube with minimal contact with the internal walls. This reduces the possibility of the stick catching or stopping in the tube, and reduces the chances for any damage to the stick; chemical sticks are rather delicate in construction.

Figure 5:
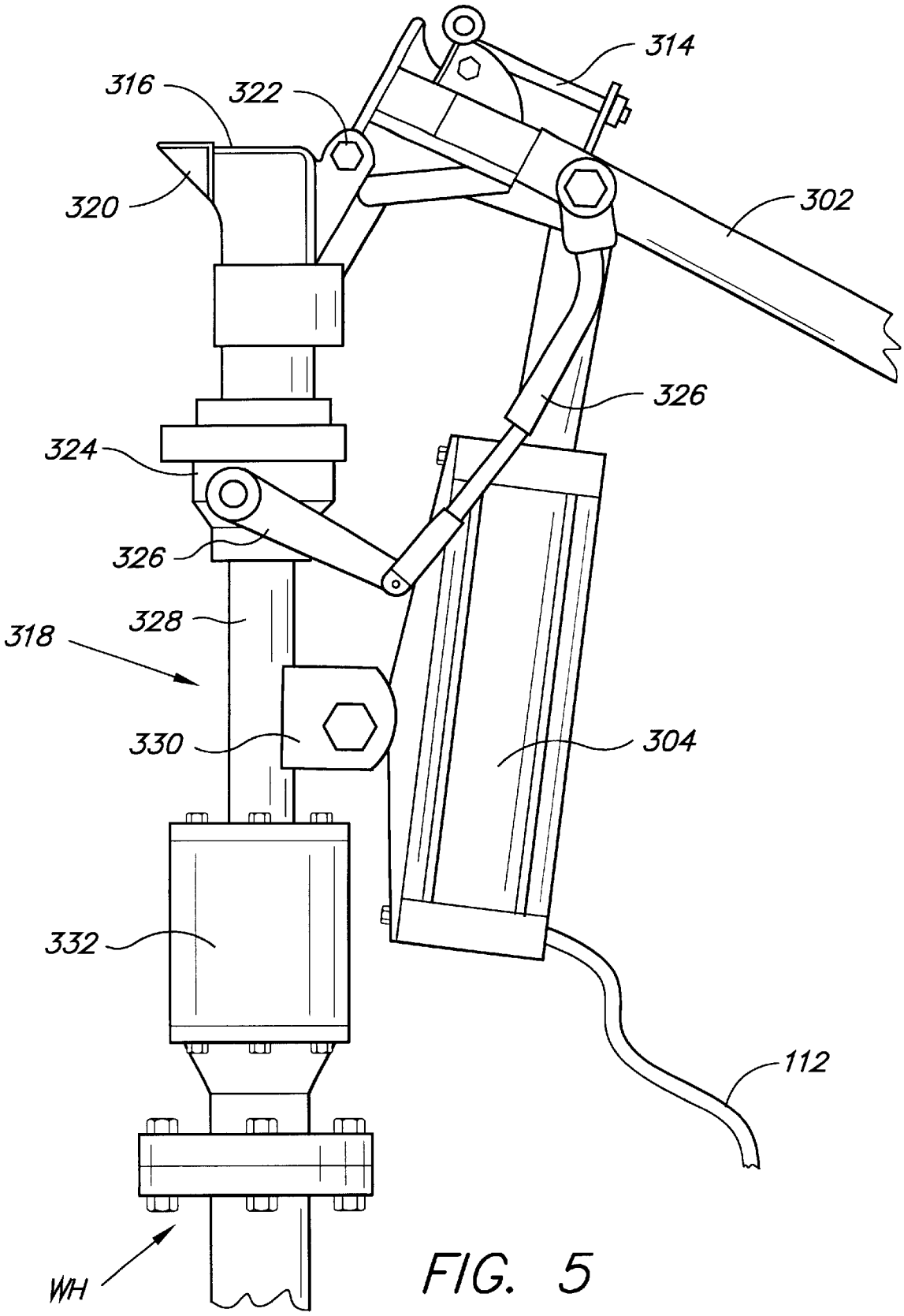
FIG. 5 is an elevational view of the stick loader mechanism atop the well head, with the launch tube lowered.
Figure 10:
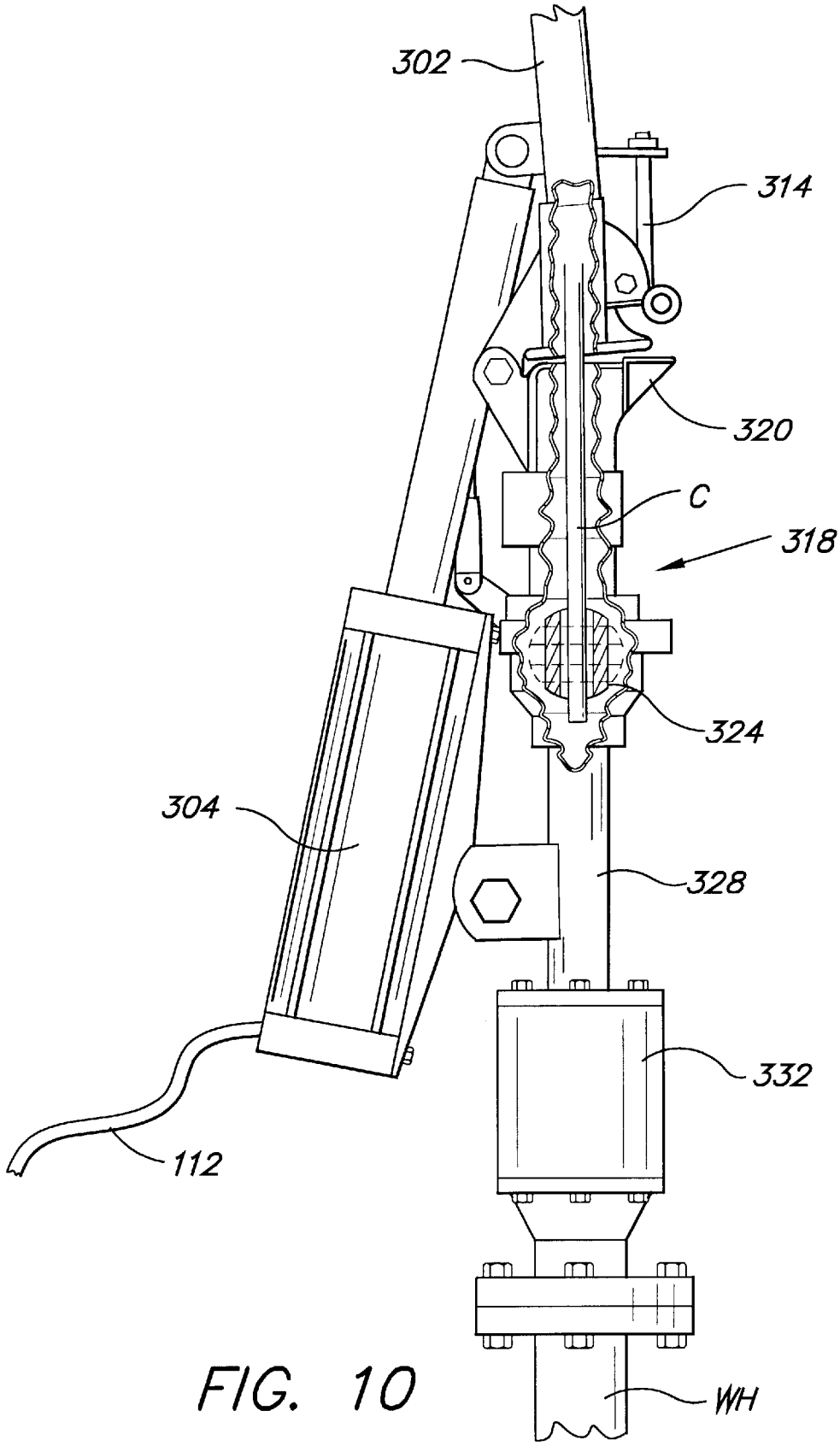
FIG. 10 is an elevational, diagrammatic view of a stick passing through a ¼ turn, rotary ball valve at the top of the well head stick-loading assembly.

Referring again to FIG. 5, the main parts of the stick loader 318 will be discussed. Tube 302 is hinged to stick loader 318 at 322. A rotary ball valve 324 is operated from connecting linkage 326 to launch tube 302; as the tube 302 is fully elevated to the position shown in FIG. 6, ball valve 324 is opened, meaning its open center is aligned vertically to allow a stick to pass therethrough into a central loading and pressure equalizing chamber 328 as can be seen in FIG. 10. Incidentally, gas operated lift cylinder is pivotally mounted at 330 to a side of chamber 328 as shown. A self-dumping valve 332 is opened by the weight of a stick once ball valve 324 is closed, meaning that the launch tube is fully lowered as shown in FIG. 5, and well pressure has been introduced into the now isolated chamber 328. A chemical stick then falls through the self-dumping valve 332.

Figure 7:
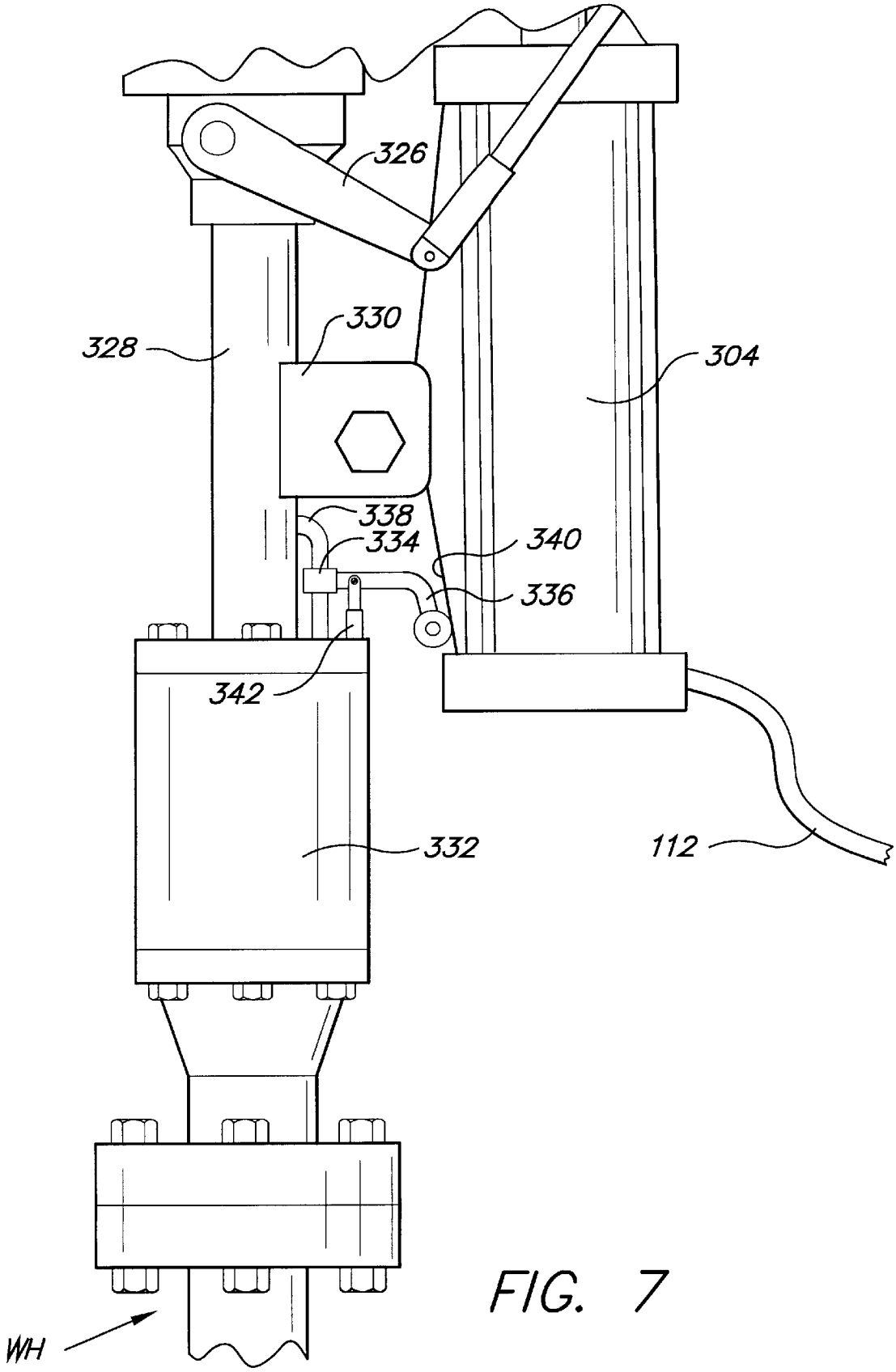
FIG. 7 is an enlarged scale, somewhat diagrammatic elevational view of the operative parts of the self dumping valve of the stick loader mechanism atop the well head.
Figure 8:
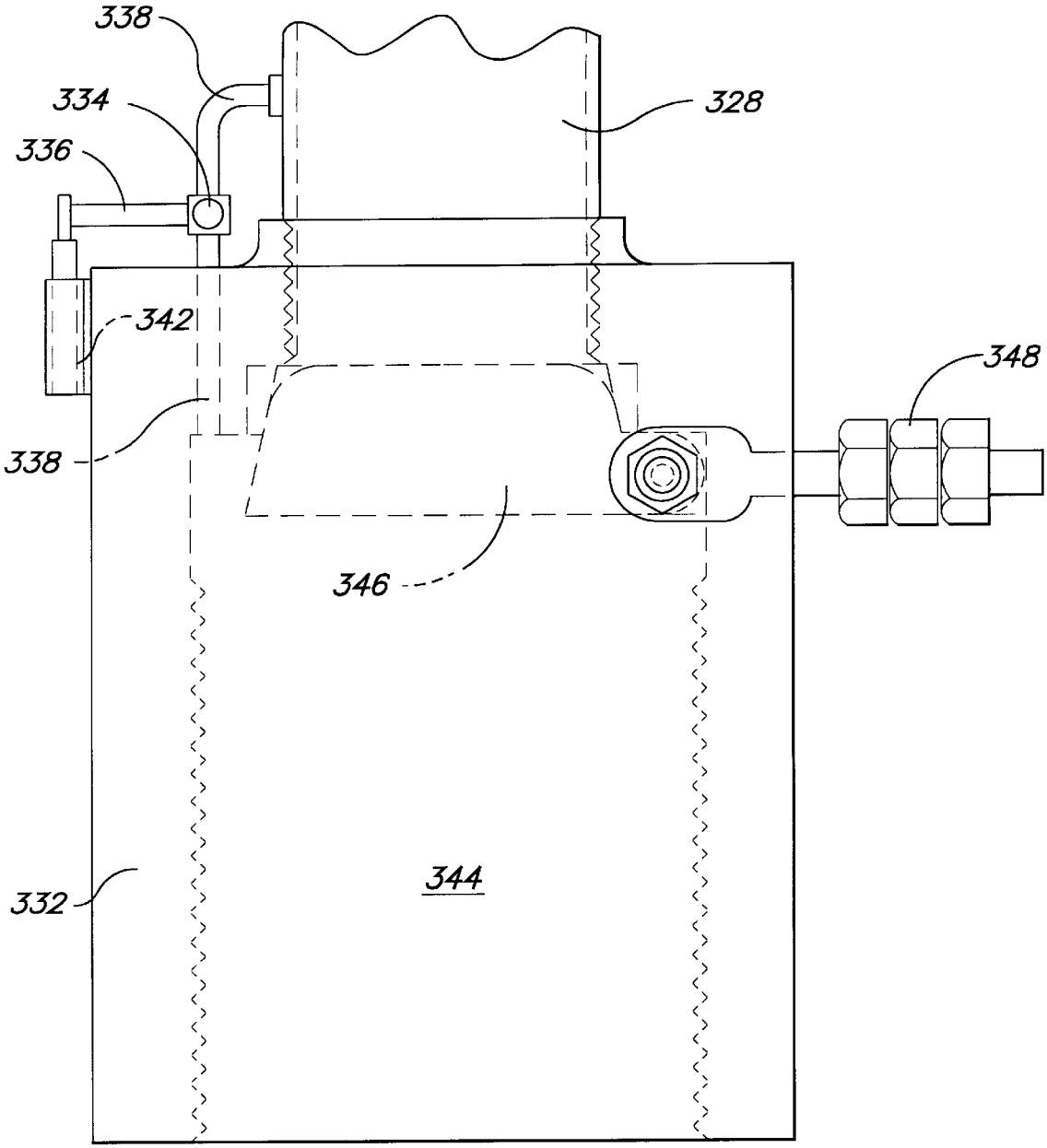
FIG. 8 is an enlarged scale view of the self-dumping valve shown in FIG. 7.

Attention is now directed to FIGS. 7 and 8 and the following discussion of the operation of chamber 328. With the tube 302 lowered and ball valve 324 closed as explained above, a self closing valve 334 with actuating arm 336 is opened to allow gas from the wellhead WH to pass through bypass line 338, because the arm 336 is against the lower part of a ramp 340 on a side of the lift cylinder 304, as is shown in FIG. 7. The arm is urged upwardly by a compression spring assembly 342, thus to open the valve 334. Turning to FIG. 8, once pressure is equalized within body 344 of self-dumping valve 332 and chamber 328, pressure against valve head 346 is reduced so that weight of a stick thereabove is sufficient to overcome the counterweight provided by weight adjustable arm 348, and allow the stick to pass through the valve and into the well, past wellhead WH.

Now, once the stick has passed into the well, valve head 346 closes, by virtue of the weight adjustable arm 348. Then, as the launch tube is lowered again (controlled from controller 100), valve 334 is closed by the arm 336 forced downwardly, as lift cylinder pivots to the left in the sense of FIG. 7 as launch tube 302 is lowered. This causes the ramp 340 to force arm 336 down. Later, when launch tube 302 is raised again with another stick, ball valve 324 is cracked open, thus to vent well head pressure within chamber 328, harmlessly to atmosphere; well pressure then firmly seats valve head 346 in place, as shown in FIG. 8.

Thus, an automatic stick loader apparatus has been shown which can be readily transported to a wellhead site, is operable fully remotely without manual intervention, and can be safely reloaded with fresh sticks from ground level as needed.

It is to be understood that the present invention is not limited to the embodiment described above, but encompasses any and all embodiments within the scope of the following claims.

We claim:

1. A chemical stick loading apparatus for a gas or oil well, comprising:

means for storing and automatically sequentially dispensing a quantity of chemical sticks, said storing means accessible from ground level to load chemical sticks thereinto;

means for sequentially receiving and lifting chemical sticks from said storing means to atop a gas or oil well head; and means for sequentially loading chemical sticks into the gas or oil well, including a first chamber for receiving a stick; means for closing said chamber and equalizing pressure therein with the pressure in the well; and means for dropping a chemical stick from said chamber into the well.

2. The chemical stick loading apparatus according to claim 1, further comprising programmable electronic means for both sequentially loading chemical sticks into said receiving and lifting means, and for operating said lifting means to lift and place a chemical stick atop the well head adjacent said chamber means.

3. The chemical stick loading apparatus according to claim 1, further comprising automatic venting means for said chamber after a chemical stick has been dropped into a well therefrom, operable by the lifting of said receiving and lifting means to load another chemical stick into the well.

4. The chemical stick loading apparatus according to claim 1, wherein said receiving and lifting means is an elongate launch tube, bowed along its length so as to allow locating said storing means closely adjacent a well head, and reduce the possibility of a stick from catching in the tube as it travels therewithin.

5. The chemical stick loading apparatus according to claim 4, said launch tube further including a remote end stick receiving cradle and a hinge connecting said cradle at the launch tube remote end, whereby said cradle receives chemical sticks sequentially from said means for storing and automatically sequentially dispensing a quantity of chemical sticks.

6. The chemical stick loading apparatus according to claim 1, wherein said storing means comprises a generally closed-wall, storage cabinet and adjustable-height support legs therearound, to adjustably position said cabinet a predetermined distance above a supporting ground surface.

7. The chemical stick loading apparatus according to claim 1, wherein said means for sequentially loading chemical sticks into the gas or oil well, including a first chamber for receiving a stick, means for closing said chamber and equalizing pressure therein with the pressure in the well, and means for dropping a chemical stick from said chamber into the well, further comprise a centrally open, rotary ball valve at the top of said chamber which, when open, allows a stick to pass therethrough and into said chamber, a self-dumping valve a bottom of said chamber which is opened when said ball valve is closed, there further being a pressure equalizing valve admitting well pressure from the well head into said chamber when said ball valve is closed, said self-dumping valve being opened by weight of a stick thereagainst when pressure is equalized on both sides of said self-dumping valve, thus to pass a stick into the well, there further being a weight arm assembly to close said self-dumping valve after a stick has passed thereby.

8. A chemical stick loading apparatus for a gas or oil well, comprising:

means for storing and automatically sequentially dispensing a quantity of chemical sticks, said storing means accessible from ground level to load chemical sticks thereinto;

gas cylinder means for sequentially dispensing chemical sticks, and including a gas pressure line connected to the gas or oil well;

means for sequentially receiving and lifting chemical sticks from said storing means to atop a gas or oil well head;

means for sequentially loading chemical sticks into the gas or oil well, including a first chamber for receiving a stick, means for closing said chamber and equalizing pressure therein with the pressure in the well, and means for dropping a chemical stick from said chamber into the well; and programmable electronic means for both sequentially loading chemical sticks into said receiving and lifting means by operating said gas cylinder means, and for operating said lifting means to lift and place a chemical stick atop the well head adjacent said chamber means.

9. A chemical stick loading apparatus for a gas or oil well or the like according to claim 8, further comprising solar power means for powering said programmable electronic means.

10. The chemical stick loading apparatus according to claim 8, further comprising automatic venting means for said chamber after a chemical stick has been dropped into a well therefrom, operable by the lifting of said receiving and lifting means to load another chemical stick into the well.

11. The chemical stick loading apparatus according to claim 8, wherein said receiving and lifting means is an elongate launch tube, bowed along its length so as to allow locating said storing means closely adjacent a well head, and reduce the possibility of a stick from catching in the tube as it travels therewithin.

12. The chemical stick loading apparatus according to claim 11, said launch tube further including a remote end stick receiving cradle and a hinge connecting said cradle at the launch tube remote end, whereby said cradle receives chemical sticks sequentially from said means for storing and automatically sequentially dispensing a quantity of chemical sticks.

13. The chemical stick loading apparatus according to claim 8, wherein said storing means comprises a generally closed-wall, storage cabinet and adjustable-height support legs therearound, to adjustably position said cabinet a predetermined distance above a supporting ground surface.

14. A method for loading chemical sticks sequentially into a gas or oil well head, comprising the steps of:

storing a quantity of chemical sticks at ground-accessible level in a weather-tight storage compartment;

programmably sequentially loading chemical sticks from the storage compartment into a receiver and lifter;

raising the receiver and lifter with a chemical stick to a position substantially, directly over a well head and then into a pressure isolation chamber;

equalizing pressure in the chamber with that of the well beneath the well head; and dropping the chemical stick into the well.

15. The method for loading chemical sticks sequentially into a gas or oil well head as claimed in claim 14, further comprising the steps of:

closing and pressure-isolating the chamber from the well after the stick is dropped from the chamber; and simultaneously lowering the receiver and lifter to a position adjacent the storage cabinet to receive the next chemical stick.

16. The method for loading chemical sticks sequentially into a gas or oil well head as claimed in claim 15, further comprising the step of:

venting the chamber as the receiver and lifter is raised to load a next chemical stick into the well.

* * * * *